United States Patent [19]

Gram et al.

[11] Patent Number: 4,808,133

[45] Date of Patent: Feb. 28, 1989

[54] MARKER BUOY WITH SELF RETRACTING LINE

[75] Inventors: Michael Gram, Oxnard, Calif.; James R. Austin, 27049 Rio Bosque Dr., Valencia, Calif. 91355

[73] Assignee: James Austin, Valencia, Calif.

[21] Appl. No.: 21,305

[22] Filed: Mar. 3, 1987

[51] Int. Cl.[4] ..... B63B 21/52

[52] U.S. Cl. ..... 441/6; 441/26; 441/21

[58] Field of Search ..... 441/6, 7, 21-28; 242/107, 107.3, 107.4 R, 107.4 C

[56] References Cited

U.S. PATENT DOCUMENTS

| | | | |
|---|---|---|---|
| 706,804 | 8/1902 | Crouch, Jr. | 441/26 |
| 1,416,336 | 5/1922 | Czeperko | 441/26 |
| 2,830,309 | 4/1958 | Lawson | 441/21 |
| 3,005,215 | 10/1961 | Colt et al. | 441/26 |
| 3,020,567 | 2/1962 | Colt | 441/26 |
| 3,407,775 | 10/1968 | Lunde | 114/293 |
| 3,827,093 | 8/1974 | Davis | 441/21 |
| 3,841,255 | 10/1974 | Mansfield | 114/294 |
| 3,913,514 | 10/1975 | Reynolds | 114/297 |
| 3,918,113 | 11/1975 | Talkington | 441/21 |
| 3,927,636 | 12/1975 | Childers et al. | 114/294 |
| 3,929,087 | 12/1975 | Montgomery | 114/230 |
| 4,014,478 | 3/1977 | Bonacina | 441/25 |
| 4,051,800 | 10/1977 | Farstad | 114/297 |
| 4,067,287 | 1/1978 | Sabella | 114/299 |
| 4,107,804 | 8/1978 | Bennett | 441/24 |
| 4,161,922 | 7/1979 | Fogg | 114/297 |
| 4,246,671 | 1/1981 | Swenson | 441/26 |
| 4,470,557 | 9/1984 | Ernst | 242/107.4 |

*Primary Examiner*—Joseph F. Peters, Jr.
*Assistant Examiner*—Edwin L. Swinehart
*Attorney, Agent, or Firm*—Spensley Horn Jubas & Lubitz

[57] ABSTRACT

An anchor locating buoy system is provided with a self-retracting anchor line. The buoy system automatically collects and stores any excess portion of line between a marker float and an anchor thereby minimizing the distance between the marker float and the anchor.

6 Claims, 4 Drawing Sheets

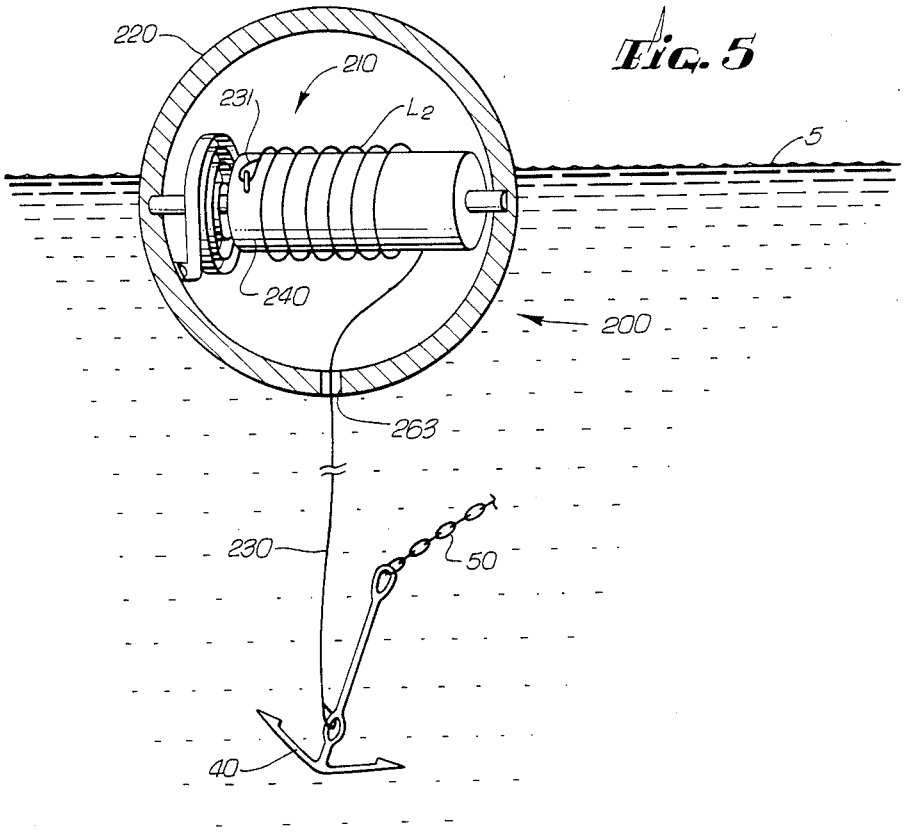
Fig. 5
Fig. 7
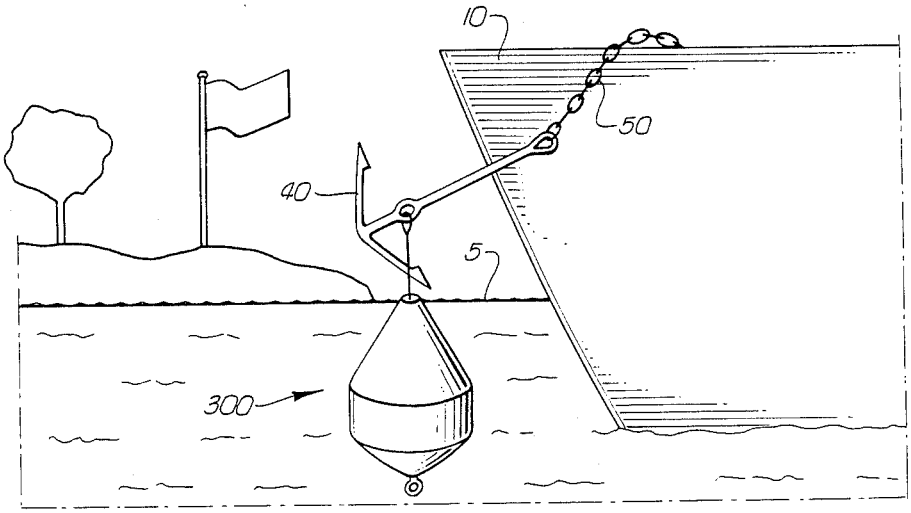

320
320a
321
340
340a
350
348
346
342b
343
342a
348
347
347
372
370
345
340b
348
372
360
300
320b
380
320c
320c
320c
363

MARKER BUOY WITH SELF RETRACTING LINE

BACKGROUND OF THE INVENTION

1. Field of the Invention

The present invention relates to a marker buoy and more specifically to a buoy used to mark the location of a submerged anchor.

2. Description of the Related Art

When a small boat 10 such as shown in FIG. 1 is to be moored, an anchor locating line 30 is typically fastened between a marker float 20 (which may be as simple as an empty plastic bottle) and a tripping point 45 of an anchor 40 before dropping the anchor 40 into the water. Referring to FIG. 2, it can be seen that after the anchor 40 submerges and catches hold of an anchorage fixture 70 at a vertical depth D below the water surface 5, the anchor locating float 20 remains within a circular marking perimeter 65 above the submerged anchor 40. The diameter of the marking perimeter 65 is dependent on the difference between the length L of the locating line 30 and the vertical depth D at the particular anchorage site. If the line 30 is made too short (i.e., $L<D$), the float 20 will become completely submerged such that it is no longer visible and thus not functional.

The locating line 30 is often formed by measuring out a fixed length L of cord that is slightly longer than an expected water depth D at the anchorage site. Opposed ends of the cord are then fastened to the tripping point 45 of the anchor and to a float 20, and the float 20 is tossed overboard before dropping anchor. As the anchor drops, a length of anchor chain 50, which is longer than the vertical depth D, and is attached to a load point 47 on the anchor 40, is paid out to create slack in the anchor chain 50. The slack allows the anchor chain 50 to exert a desirable, substantially non-vertical pull on the load point 47 once the anchor 40 catches hold of an anchorage fixture 70. This non-vertical arrangement enhances the anchor's holding power.

While it remains moored to the submerged anchor 40, the boat 10 will generally drift to the peripheral edge of a circular anchorage perimeter 60 as a result of prevailing winds and/or water currents. When it is time to break anchor, the boat 10 is brought back to the location marked by the anchor locating float 20 and the locating line 30 is pulled to apply a substantially vertical force to the tripping point 45 of the anchor in order to free the anchor from the underwater anchorage fixture 70. The anchor chain 50 is then hauled in to raise the anchor 40. The locating line 30 is generally pulled in by hand afterwards to retrieve the anchor locating float 20 before the boat 10 gets under way.

Although the above described procedure is relatively simple, several things may go awry. When the motor of the boat 10 is shut off for example, there is usually some wind or water current at the anchorage site which will swing the boat about so its bow 12 points into the current and the propeller 14 (not shown) projects under water in the other direction. The boat 10 drifts freely in this manner until the anchor 40 is dropped and attached to a submerged anchorage fixture 70. There may be projecting rocks near by or other boats in the vicinity that are to be avoided while the boat drifts freely. It is desirable to drop the anchor 40 as quickly as possible before the boat 10 drifts too close to these neighboring objects. After the marker float 20 (FIG. 1) is thrown overboard while preparing to lower the anchor 40, the prevailing winds or water currents can pull the marker float 20 back towards the propeller 14 in such a manner that the locating line 30 is fouled in the propeller 14. The boat 10 may continue to drift toward the neighboring danger points while time is consumed trying to free the fouled locating line 30. The same problem may occur when the anchor 40 is raised. Water or wind currents can pull the marker float 20 back behind the boat 10 while the anchor is being raised. The locating line 30 can again become entangled in the propeller 40 before the boat 10 gets underway.

Another problem occurs when the locating line 30 is measured out to the aforementioned fixed length L before the anchor 40 is dropped. The measured length L of the locating line 30 is preferably fixed so it will be slightly longer than the vertical depth D of the anchorage site so the float 20 will remain above water and the diameter of the marking perimeter 65 will be small. Accurate prediction of the vertical depth D is difficult however. There is no simple method for determining the depth of a yet unknown anchorage fixture 70 to which the anchor 40 will eventually attach after the anchor is dropped. Moreover, the vertical depth D varies with time as weather conditions and tide levels change. If an incorrect guess is made on the first drop of the anchor and the fixed length L of the locating line 30 is measured out to be shorter than the actual vertical depth D, the float 20 will be completely submerged and the anchor 40 must then be pulled back up so additional length can be added to the locating line 30. The boat 10 is free to drift in undesirable directions while the locating line 30 is being adjusted.

Often, it is desirable to power the propeller 14 as soon as the anchor 40 is pulled safely away from an anchorage fixture 70 so the boat 10 can get underway quickly. With the above described method, however, the anchor 40 must be pulled completely out of the water and the locating line 30 retrieved by hand before it is safe to turn on the propeller 14 so the danger of fouling the locating line 30 in the propeller 14 is avoided. In addition to being time consuming, the manual operation of retrieving the locating line 30 is inconvenient and unreliable. The last step of retrieving the line 30 is often forgotten while attempting to get underway quickly and the locating line 30 may then become fouled in the propeller 14 after the boat 10 starts to move. This causes additional delay and again raises the danger of undesirable collision with nearby objects while the boat drifts without power. An anchor marking system that avoids these problems would make leisure boating both safer and more enjoyable.

SUMMARY OF THE INVENTION

The present invention avoids problems associated with manual payout and retrieval of an anchor locating line by providing a float marking system that includes a line length control means which is attached to the locating line and applies a controlled tension to the line in order to minimize the length of line extending between the float and the anchor while allowing the float to remain at least partially above water. The marking system also includes collection means for automatically drawing in and storing any excess portion of the line.

BRIEF DESCRIPTION OF THE DRAWINGS

FIG. 5 is a sectional view of another marker buoy system in accordance with the present invention.

FIG. 7 shows the marker buoy of FIG. 6 in an inverted position.

DETAILED DESCRIPTION

Figure 1:
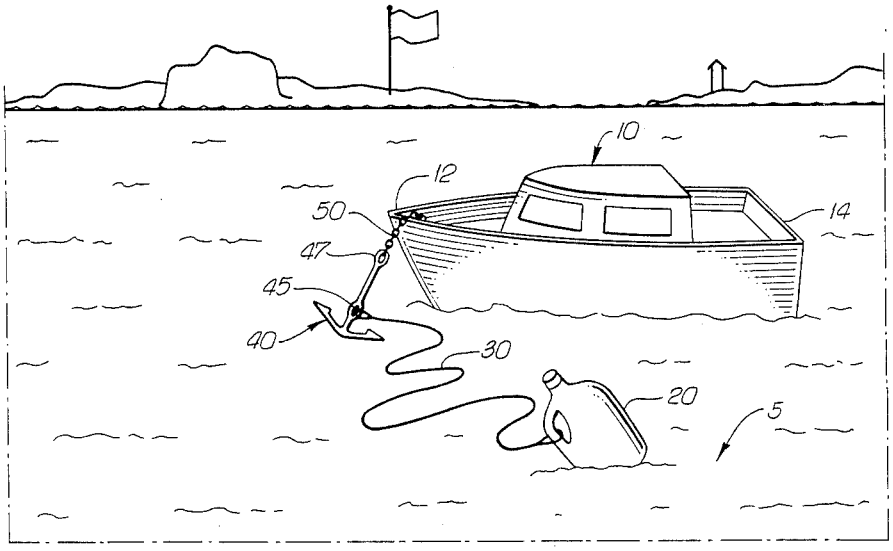
Fig. 1 PRIOR ART
FIG. 1 is a perspective view of a known anchor locating arrangement with the anchor positioned out of the water.
Figure 2:
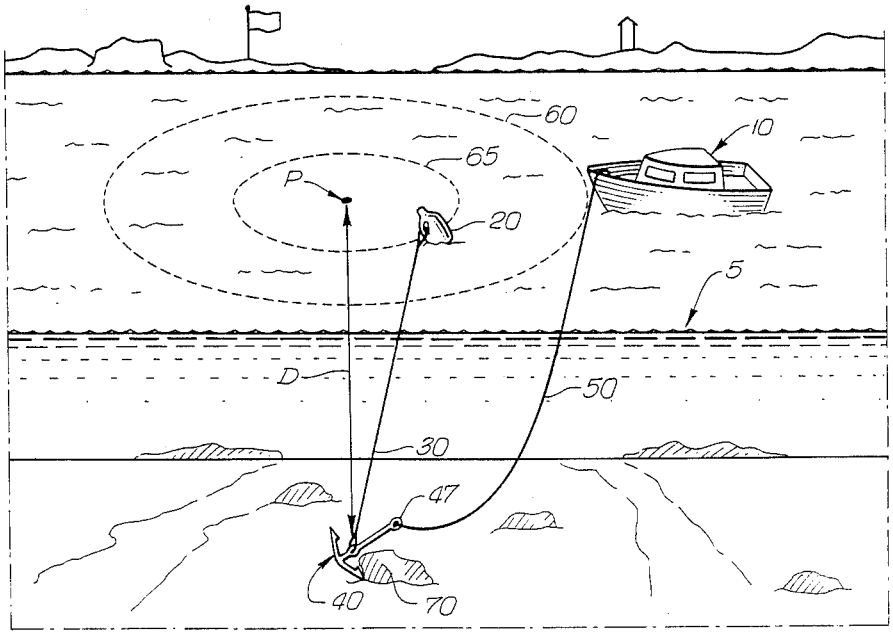
FIG. 2 is a perspective view of the known anchor locating arrangement with the anchor positioned below the water surface and attached to a submerged anchor fixture.
Figure 3:
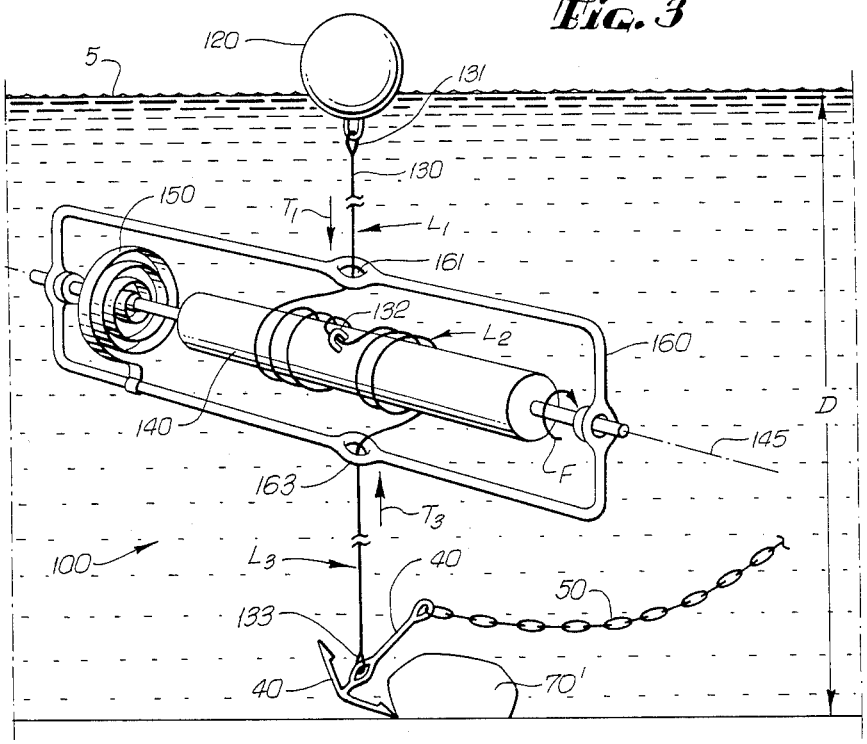
FIG. 3 is a sectional view of a first marker buoy system in accordance with the present invention.

A first marker buoy system 100 in accordance with the present invention is shown in FIG. 3. A locating line 130, preferably made of nylon cord, has a predetermined length L which is divided into top, middle, and bottom segments that are respectively referred to as $L_1$, $L_2$ and $L_3$. A first end 131 of the line 130 is attached to a marker float 120. The marker float 120 has a predetermined maximum buoyancy force. The second end 133 of the line is connected to an anchor 40. The middle segment $L_2$ of the line length L is wrapped about a collecting spool 140. The collecting spool 140 is rotatably mounted in a frame 160 and urged to rotate about its axis of rotation by an applied rotating force F. The magnitude of the rotating force F is controlled (by a spring of predetermined strength for example) such that it applies opposed tensional forces $T_1$ and $T_3$ to respective top and bottom segments $L_1$ and $L_3$ to thereby minimize the summed length $L_{13}=L_1+L_3$ of the first and third segments without pulling the marker float 120 completely below the water surface 5. This means that the force F is limited to a maximum value which equals or is less than the predetermined maximum buoyancy force of the float 120. The rotating force F is preferably applied by a coiled line tensing spring 150 which is coupled between the collecting spool 140 and the frame 160. With this arrangement, the summed length $L_{13}$ can be kept approximately equal to the vertical depth D between the water surface 5 and an anchor fixing point 70 so the anchor locating marker float 120 will provide a generally good indication of the location of the submerged anchor 40 without becoming totally submerged or straying too far away from the true vertical of the anchor 40. It is to be understood that some wind or water current may be present to pull the marker float 120 slightly away from a true vertical position above the submerged anchor 40. The effect of these currents becomes magnified when the vertical depth D of an anchorage site increases. The rotating force F is therefore preferably controlled to increase as more of the line 130 is paid out from the collecting spool 140 thereby minimizing the location error which is created by such currents.

Figure 4:
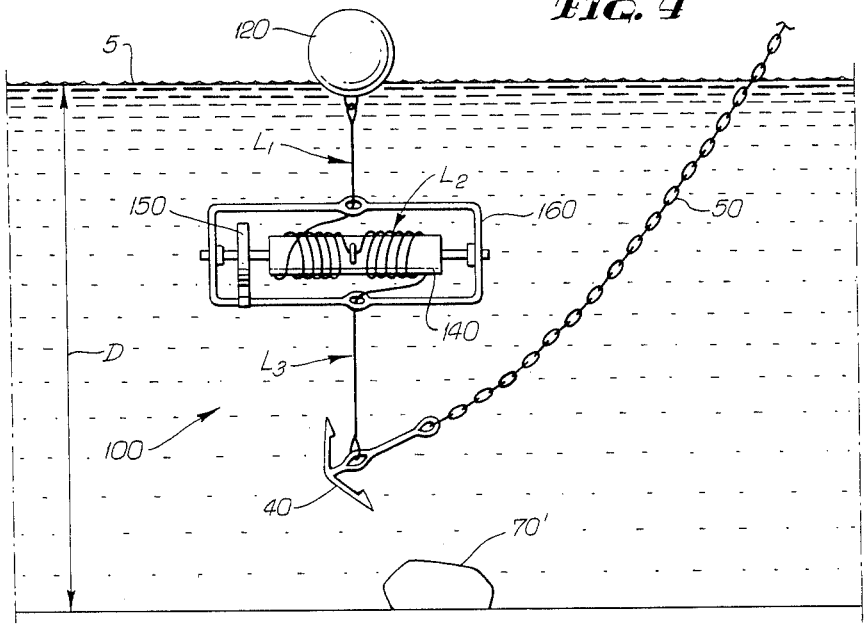
FIG. 4 shows the buoy of FIG. 3 in a state where the anchor is partially raised.

The advantage of the first marker buoy system 100 shown in FIG. 3 becomes apparent in FIG. 4. Here, the anchor 40 is shown pulled away from an anchorage fixture 70' by an anchor chain 50 which is attached to the anchor. The downward force of the anchor weight is relieved from the bottom segment $L_3$ by the anchor chain 50 as the anchor is pulled upwards. The collecting spool 140 rotates as a result of the applied rotating force F to collect an excess portion of the line length L so that the top and bottom line segments $L_1$ and $L_3$ are shortened while the middle line segment $L_2$ is collected about the spool 140. The locating line 130 will be almost completely wound about the collecting spool 140 by the time the anchor 40 is raised to the water surface 5. This means that the marker float 120 will be drawn adjacent to the anchor 40 as the anchor 40 is raised out of the water. There is therefore no need for retrieving the line 130 by hand since the line 130 will be already collected around the collecting spool 140. The additional time for retrieving the anchor line 130 by hand is bypassed and the boat 10 (not shown) can get underway that much sooner.

Still referring to FIG. 4, it will also become apparent that an accurate prediction of the water depth D at a new anchorage site 70' is not necessary when the anchor is dropped because the line 130 will pay out from the spool 140 by an amount approximately equal to the water depth D of the new anchorage site 70' while any excess line is pulled in and collected by the collecting spool 140. The summed length $L_{13}=L_1+L_3$ will automatically adjust to variations in water depth resulting from changing tide levels or other weather conditions.

In FIG. 5, a second marker buoy system 200 within the spirit of the invention is shown. It has a line length control means 210 that is incorporated within a marker float 220 so an excess portion $L_2$ of a locating line 230 will be wound about a collecting spool 240. The collecting spool 240 is rotatably mounted within the marker float 220. A first end 231 of the locating line 230 is attached to the collecting spool 240 while a second end 233 connects to an anchor 40 through a guiding hole 263 provided at a bottom portion of the float 220.

Figure 6:
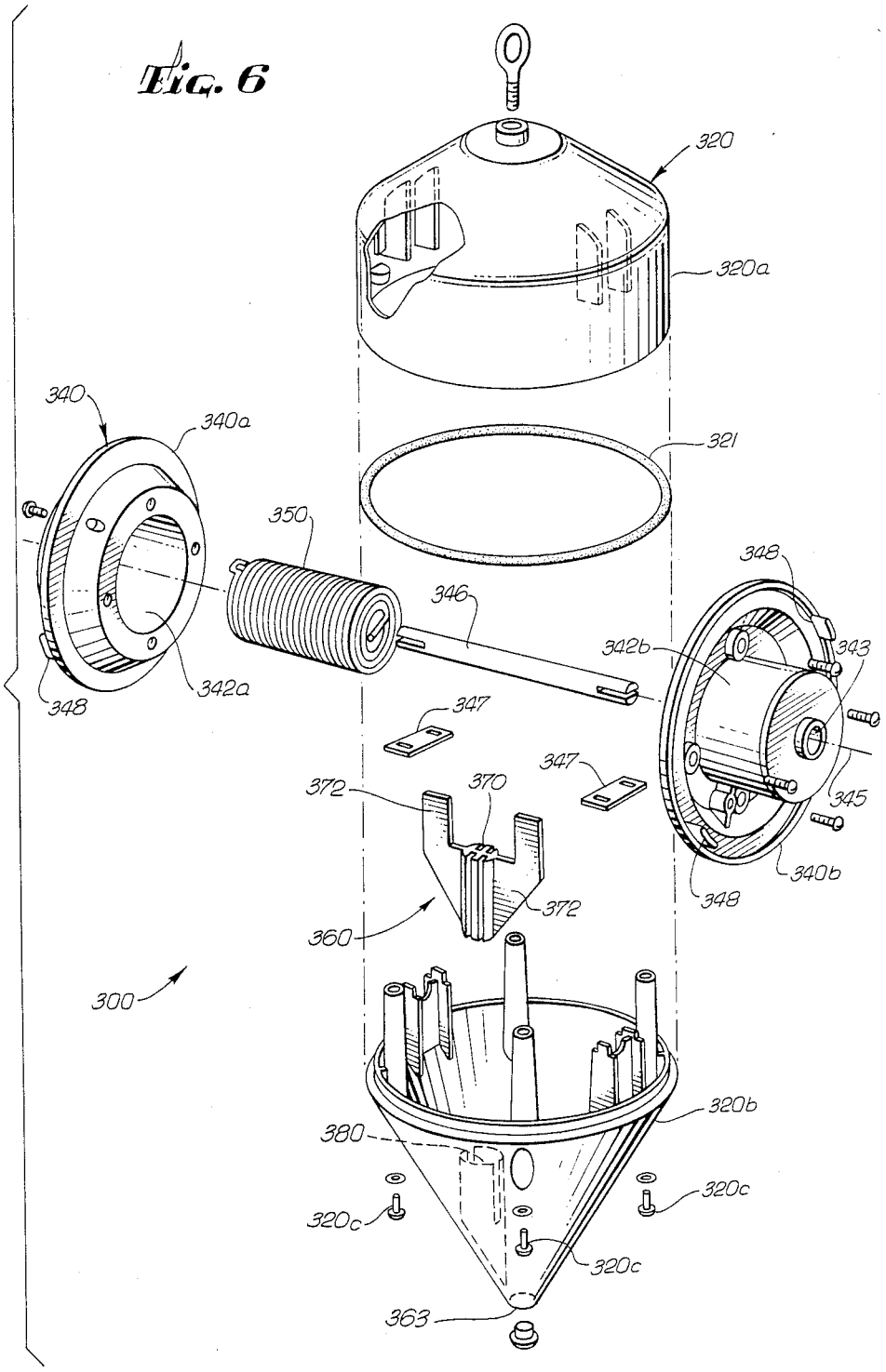
FIG. 6 is an exploded view of a self-rewinding marker buoy in accordance with the present invention.

FIG. 6 is an exploded view of a self-contained marker buoy 300 in accordance with the present invention. The buoy 300 has a hollow shell 320 which has a bottom portion **320*b* that is generally shaped as an inverted cone and includes a guide hole 363 communicating vertically through its bottom. A cup-shaped top portion 320*a* of the shell is fastened to the bottom portion by a set of fasteners 320*c* to make the shell 320 substantially watertight. An elastic O-ring 321 is preferably inserted between the top and bottom portions, 320*a* and 320*b*. The hollow portion of the shell 320 acts as a floatation chamber which keeps the marker buoy 300 afloat. A collecting drum 340 is formed by joining two drum halves 340*a* and 340*b*. Each drum half, 340*a* and 340*b*, has a respective central hub section 342*a* and 342*b* projecting outwardly in alignment with a selected axis of rotation 345. Holes 343 are provided in each drum half for passing through an axle 346 which is fixed to the shell by a pair of retaining clips 347. A toroidal coil spring 350 is provided enclosed within the adjoined hubs of the drum halves with one end of the spring coupled to the axle 346 and the other end attached to one of the drum halves. The axle 346 passes through the center of the toroidal spring 350. The coil spring 350 is tensed when the collecting drum 340** rotates as a locating line (not shown) unravels from the drum. Preferably, the tension of the spring increases as more of the locating line is paid out.

The buoy 300 contains a gravity lock system 360 which impedes undesirable payout of the line while the buoy 300 is in an inverted position (bottom portion up, as shown in FIG. 7). The gravity lock system, as shown in FIG. 6, includes a slidable weight 370 that has a pair of flexible ears 372 projecting upwardly therefrom to engage a plurality of complementary dogs 348 which are provided projecting from the drum 340. When the buoy 300 is in an upright position (bottom portion down) such as as shown in FIG. 6, the weight 370 slides down into a receiving tube 380 and pulls the ears 372 free of the dogs 348 so the drum 340 is able to rotate. When the buoy 300 is inverted such that its bottom portion is at the top (FIG. 7), the weight 370 slides down out of the receiving tube 380 to cause the flexible ears 372 to engage the dogs 348 and thereby impede rotation of the drum 340. The ears 372 are preferably made flexible to allow the gravity lock system to unlock from an engaged state when the tension of the line exceeds a predetermined threshold level. The threshold level can be exceeded, for example, when an anchor is dropped quickly into the water while the float is still inverted. In that case, the weight 370 will be out of the receiving tube 380 and the dogs 348 will be pressingly engaged by the ears 372, first as a result of the weight of the buoy itself, and soon thereafter because of the line tension created by the weight of the dropping anchor. If the ears and/or dogs were made of inflexible materials, the weight of the dropping anchor would cause the system to lock up. The sliding weight 370 would be impeded from retracting into the receiving tube 380 by the friction of the ears locking against the dogs of the drum.

As mentioned, the coil spring 350 is preferably fabricated to apply an increasing tension to the locating line as more line unravels from the drum 340. This helps to keep the marker float 300 closer to the true vertical of the anchorage site 70 as the water depth D increases. It will be noted that the tension of the spring could be measured to indicate the depth D of an anchorage site by placing depth markings on the outside of the shell 320 for example. When the line tension increases, the water mark of the shell moves up along the outside of the shell as more of the buoy 300 becomes submerged.

It should be noted that the conical shape of the lower shell portion **320*b* allows the buoy 300 to shed surface debris such as kelp and also aids in the drainage of any water which may collect inside the shell 320**.

Numerous variations of the disclosed invention will become apparent to those skilled in the art. The scope of the invention is accordingly not to be limited to the above described embodiments but rather defined by the following claims and equivalents thereof.

We claim:

1. An anchor locating buoy for marking the position of a submerged anchor, comprising:

a location marking line of predetermined length, attached to the float, for linking the float to the anchor; and line length control means, attached to the line, for applying a controlled tension to the line in order to minimize the length of line extending between the float and the anchor while allowing the float to remain at least partially above water, including line collection means for drawing in and storing an excess portion of the predetermined line length, wherein the controlled tension applied to the line varies as a function of the distance between the float and the anchor, generally increasing as the distance increases, wherein the control means includes a gravity lock means for impeding payout of the anchor locating line while the control means is inverted.

2. An anchor locating buoy according to claim 1 wherein the gravity lock means includes a slidable weight provided with a flexible ear, the ear of the slidable weight being adapted to engage and disengage with a portion of the line collection means when the control means is respectively brought to an inverted or upright position.

3. A marker buoy comprising:

a marking line of predetermined length;

a generally watertight shell having a flotation chamber defined in an interior portion thereof and a guide hole provided at a bottom portion of the shell, the guide hole communicating between the floatation chamber and the exterior of the shell and guiding the marking line from the exterior to the floatation chamber of the shell;

an axle, provided within the floatation chamber and fixedly fastened to the shell;

a coiled spring provided about the axle, including a first end which is connected to the axle;

a line collecting drum, rotatably supported within the flotation chamber by the axle and adapted to collect a protion of the marking line thereabout, wherein the drum has a hub section enclosing the coiled spring at least partially and wherein a second end of the coiled spring is connected to the drum;

wherein the shell includes a top portion which is shaped generally like an inverted cup and a bottom portion, which is fastened to the top portion and shaped generally like an inverted cone, the guide hole being provided at a lower section of the bottom portion; and wherein the drum is provided with a locking dog;

a receiving tube is provided vertically within the bottom portion of the shell; and a weight is provided slidably within the receiving tube, the weight and receiving tube being adapted such that the weight will slide toward the drum when the shell is in a upright position, wherein the weight includes a locking ear which is engageable with the locking dog of the drum when the shell is inverted such that the engagement of the dog and ear will impede rotation of the drum.

4. A marker buoy according to claim 3 wherein at least one of the locking dog and ear is flexible such that the drum will rotate once a predetermined rotational threshold force is exceeded.

5. An improved anchor locating buoy for marking the position of a submerged anchor, comprising:

a location marking float;

an anchor locating line of predetermined length, attached to the float, for linking the float to the anchor; and line length control means, attached to the line, for applying a controlled tension to the line in order to minimize the length of line extending between the float and the anchor while allowing the float to remain at least partially above water, including line collection means for drawing in and storing an excess portion of the predetermined line length, wherein the control means includes a gravity lock means for impeding payout of the anchor locating line while the control means is inverted.

6. An anchor locating buoy according to claim 5 wherein the gravity lock means includes a slidable weight provided with a flexible ear, the ear of the slidable weight being adapted to engage and disengage with a portion of the line collection means when the control means is respectively brought to an inverted or upright position.

* * * * *